US006325151B1

(12) United States Patent
Vincent et al.

(10) Patent No.: US 6,325,151 B1
(45) Date of Patent: Dec. 4, 2001

(54) PACKER ANNULUS DIFFERENTIAL PRESSURE VALVE

(75) Inventors: Ray Vincent, Cypress; Rocky A. Turley, Houston, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/560,450

(22) Filed: Apr. 28, 2000

(51) Int. Cl.[7] ..... E21B 34/00
(52) U.S. Cl. ..... 166/334.4; 166/183
(58) Field of Search ..... 166/334.4, 323, 166/334.1, 183, 188

(56) References Cited

U.S. PATENT DOCUMENTS

| | | | | |
|---|---|---|---|---|
| 3,079,996 | * | 3/1963 | Tamplen | 166/183 |
| 4,657,083 | | 4/1987 | Ringgenberg | 166/374 |
| 4,834,176 | | 5/1989 | Renfroe, Jr. | 166/142 |
| 6,112,816 | * | 9/2000 | Orzechowski et al. | 166/324 |
| 6,220,359 | * | 4/2001 | Poulard | 166/334.4 |
| 6,230,811 | * | 5/2001 | Ringgenberg et al. | 166/374 |

* cited by examiner

*Primary Examiner*—William Neuder
(74) *Attorney, Agent, or Firm*—Madan, Mossman & Sriram, P.C.

(57) ABSTRACT

The invention is a well fluid production valve that is positioned downhole in a closed condition below an upper formation packer. The valve comprises a cylindrical mandrel having central bore flow connection with the upper bore of well fluid production tubing and coaxially aligned within the lower bore of the production tubing string. Flow port apertures through the mandrel wall provide well fluid flow paths between the mandrel O.D. and the bore I.D. of the lower production tubing. These flow ports are covered to close the valve by a sliding sleeve around the mandrel O.D. The sliding sleeve is spring biased to the open position but also secured at the closed valve position by an annular piston actuated sear mechanism. Actuation pressure for opening the valve to admit a flow of well fluids from the production zone is a predetermined differential between the well pressure above the packer, usually a function of the well depth, and the operator controlled pressure within attached production tubing. The formation pressure, which may be more or less than the corresponding head pressure, is isolated from the valve actuator and therefore does not contribute to the valve actuating pressure. A fluid pressure conduit is provided that transmits fluid pressure from a well annulus zone above the upper formation packer down past the packer to the upper face of the annular piston within an annular valve actuation cylinder. Production tubing bore pressure is routed to bear upon the lower face of the annular piston. Sufficient pressure differential on the annular piston displaces the sear piston from the sleeve holding position with the sear piston removed. The standing spring bias on the sleeve slides it along the mandrel O.D. to open the flow ports.

11 Claims, 2 Drawing Sheets

PACKER ANNULUS DIFFERENTIAL PRESSURE VALVE

BACKGROUND OF THE INVENTION

1. Field of the Invention

The present invention relates to the tools and methods for producing fluids from within the Earth. More particularly, the present invention relates to a pressure differentially operated production valve.

2. Description of the Prior Art

In the industrial context of petroleum production and earth boring, pressure differentially operated production valves are flow control devices positioned downhole within a petroleum production tube. One purpose for which the valve is used is for isolating a petroleum production zone during the well completion process. After one or more annulus isolation packers are set above or below or both relative to the production zone, the differential valve is opened to permit well fluid flow into the production tube. The valve is opened by elevated fluid pressure within the production or completion tube after the packers are set and the production zone is isolated from the atmospheric surface.

Prior art valves are opened by a pressure value that is the differential between the tubing bore pressure and the well annulus pressure. Consequently, the magnitude of fluid pressure essential for opening the valve is dependent on the annulus pressure in the immediate proximity of the valve. However, because the production zone is isolated from the atmospheric surface head by the packers above the production zone, the production zone pressure is not always known. In isolation, the production zone pressure may be considerably greater or less than the surface head. This unknown in the production zone pressure is translated to an unknown pump pressure required to open the valve.

It is therefor, an object of the present invention to provide a downhole production valve having an operating pressure that is independent of the production zone pressure.

Also an object of the invention is a downhole valve that is operatively responsive to the annulus pressure above a predetermined uphole packer.

SUMMARY OF THE INVENTION

The invention is a well fluid production valve that is positioned downhole in a closed condition below an upper formation packer. Actuation pressure for opening the valve to admit a flow of well fluids from the production zone is a predetermined differential between the well pressure above the packer, usually a function of the well depth, and the operator controlled pressure within attached production tubing. The formation pressure, which may be more or less than the corresponding head pressure, is isolated from the valve actuator and therefore does not contribute to the valve actuating pressure. A fluid pressure conduit is provided that transmits fluid pressure from a well annulus zone above the upper formation packer down past the packer and internally thereof to the valve actuation cylinder.

The well fluid flow ports of the valve are slots or large apertures in a cylindrical mandrel. Concentrically around the mandrel and radially spaced therefrom is an exterior tubing wall. The well fluid flow path is from an annular space between the mandrel and the interior bore of the production tubing below the valve ports.

Within this annular space is a fluid pressure cylinder, preferably disposed above the valve ports. The upper end of this cylinder is in open fluid communication with the well annulus above the packer. The lower end of the cylinder terminates in the proximity of the valve ports. Below the cylinder lower termination, the annular space between the mandrel and the production tube bore enlarges radially. The well valve operator is a sliding sleeve having a fluid pressure sealed fit to the surface of the mandrel and to the lower end of the annular cylinder. The sleeve wall thickness is sufficiently thin to allow adequate flow area between the O.D. surface of the sleeve and the I.D. surface of the tubing bore below the cylinder when the sleeve is axially displaced below the flow ports at an open port position for fluid flow. The valve operator sleeve Is biased to the open port position by a coiled tensile spring wound about the mandrel below the operator sleeve.

Collet fingers extend upwardly from the upper edge of the operator sleeve closely alongside the mandrel O.D. These collet fingers include chocks that bear resiliently against the mandrel O.D. surface. When the operator sleeve is axially aligned along the mandrel to close the flow ports, the collet finger chocks mesh with depressions in the O.D. surface of the mandrel to oppose the displacement bias of the coiled tensile spring.

Holding the collet finger chocks in the mandrel depression is a sear mechanism including the circumferential skirt of an annular piston. The sear piston makes a fluidtight seal with the annular cylinder between the mandrel O.D. and the tubing I.D. The sear piston skirt extends axially from the lower edge of the piston to tightly fill the annular space between the collet fingers and the tubing I.D. Notwithstanding the coiled spring bias, the collet fingers cannot flex sufficiently to lift the chocks out of the mandrel depressions. Hence, the operator sleeve is locked at the closed flow port position.

The operator sleeve closes the flow port by an outer O-ring seal between the O.D. of the sleeve and the I.D. of the cylinder above the flow port and an inner O-ring seal between the I.D. of the sleeve and the O.D. of the mandrel below the flow port. Consequently, although the flow port is closed between the inner bore of the mandrel and the fluid flow annulus between the mandrel O.D. and the inner bore of the production tube, a fluid pressure conduit remains between the inner bore of the mandrel and a bottom face of the annular piston. This fluid conduit is routed through the flow ports and longitudinal slots between the collet fingers. Accordingly, opposing faces of the piston are subjected to different pressure sources: the upper face bearing the above packer annulus pressure and the lower face bearing the mandrel internal bore pressure.

The internal bore of the mandrel is open with the upper production tube bore and is served by service pumps at the well surface. Hence, the internal bore of the mandrel is a controlled variable whereas the upper well annulus is a substantially known constant.

The sear piston is secured at the flow port closed position by a shear pin or screw fastener. When opening is desired, pressure within the internal bore of the mandrel is increased to generate sufficient pressure differential with the uphole annulus pressure to shear the piston fastener. When the shear fastener fails due to the pressure induced force differential, the annular piston slides upwardly to remove the piston skirt from the collet blocking position. The coil spring bias is constantly present and when the collet blocking skirt is removed, the standing bias on the operator sleeve pulls the sleeve collet chocks out of the depression and the sleeve away from the flow port blocking position whereupon the valve is opened.

BRIEF DESCRIPTION OF THE DRAWINGS

Relative to the following description of the preferred embodiments of the invention, like reference characters designate like or similar elements throughout the several figures of the drawings and.

DETAILED DESCRIPTION OF THE PREFERRED EMBODIMENTS

The invention is a well fluid production valve that is positioned downhole in a closed condition below an upper formation packer. Actuation pressure for opening the valve to admit a flow of well fluids from the production zone is a predetermined differential between the well pressure above the packer, usually a function of the well depth, and the operator controlled pressure within attached production tubing. The formation pressure, which may be more or less than the corresponding head pressure, is isolated from the valve actuator and therefore does not contribute to the valve actuating pressure. A fluid pressure conduit is provided that transmits fluid pressure from a well annulus zone above the upper formation packer down past the packer and internally thereof to the valve actuation cylinder.

Figure 1:
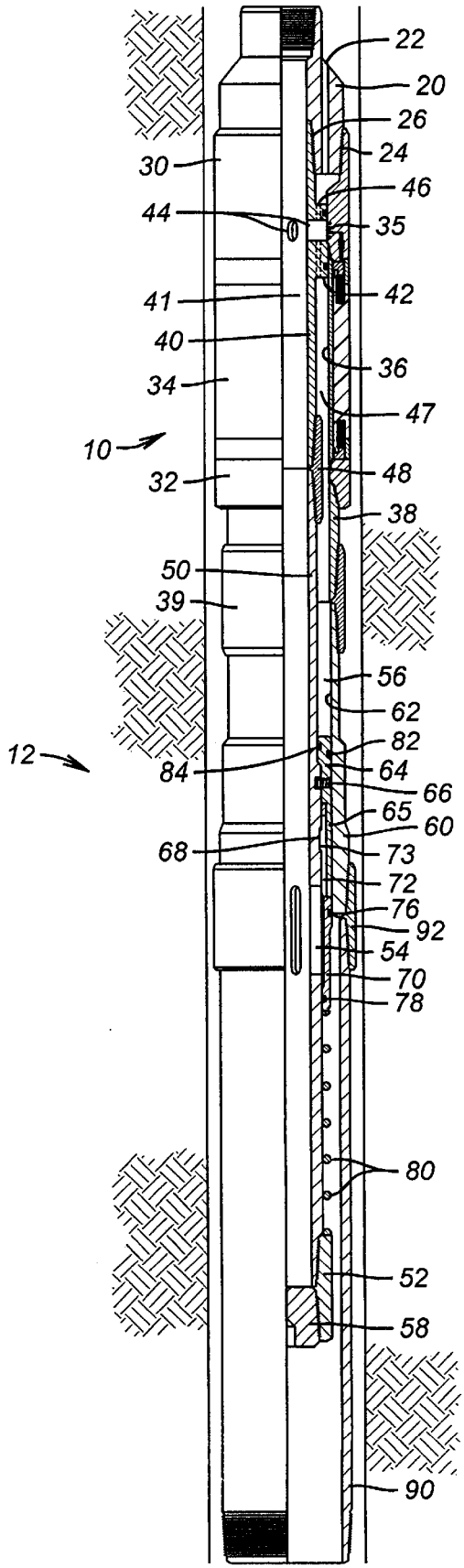
FIG.1 is an axial quarter section view of the invention in the closed, well entry set condition; and, FIG. 2 is an axial quarter section view of the invention in the open, well fluid flow condition.

With respect to the sectional drawing of FIG. 1, a well production tube may include numerous special purpose tools in a connected series. The present invention represents only one of the several possible tool combinations and, in the presently preferred embodiment, is a combination of two tools: a wellbore packer 10 and a sleeve valve 12. FIG. 1 illustrates the packer and valve as closely coupled. However, close proximity between the packer 10 and valve 12 is not an essential characteristic of the invention.

Considering the top of FIG. 1 as the uphole direction, the production tubing string supports a tube box joint 20 having a plurality of pressure transfer channels 22 drilled through the joint shoulder essentially parallel with the joint axis of revolution. Inside box threads 26 connect an upper valve mandrel 40 having an interior flow bore 41 that is in open flow communication with the production tubing bore above the joint 20.

Figure 2:
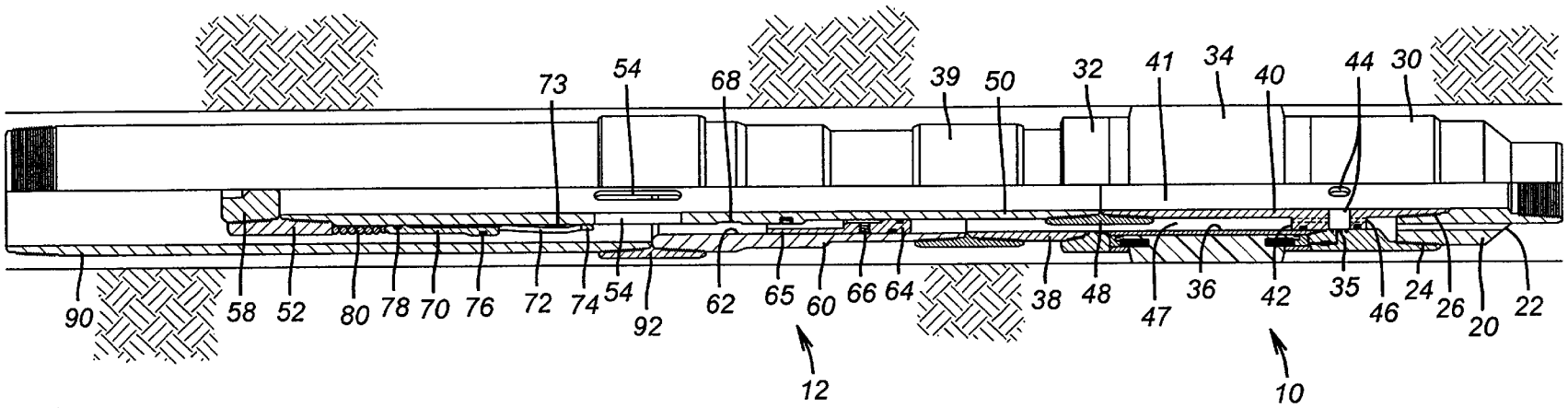

Outside box threads 24 receive the top sub 30 of a pressure actuated packer 10 having a packer boot 34 sealed around a packer mandrel 36. As illustrated by FIG. 1, the packer boot is collapsed onto the packer mandrel 36 for downhole placement. A bottom sub 32 receives the bottom end of the packer mandrel 36 and secures the lower edge of the boot 34. Internal threads on the bottom end of the bottom sub 32 are shown by FIGS. 1 and 2 to mesh with the upper external threads of a tubing sub 38. It should be recognized, however, that the assembly section represented by tubing sub 38 may be hundreds of feet long.

For the purpose of assembly convenience, the upper valve mandrel 40 is terminated proximate of the bottom packer sub 32 and is threaded for assembly with the lower valve mandrel 50 by means of a mandrel coupling 48.

At the upper end of the upper valve mandrel 40, the substantially continuous mandrel wall is perforated by a plurality of conduits 44. These conduits are provided to expose the packer valves to the central bore pressure. Those of skill in the art will know that the packer is inflated between the boot underside and the packer mandrel 36. This packer inflation flow is controlled by a valve spool 35. The end of the spool is loaded by the same pressure to irreversibly close the conduit 44 when the desired degree of packer inflation is obtained and to protect the packer from considerably greater pressure at a later time. Between the upper valve mandrel 40 and the packer mandrel 36 are fluid pressure transmission spaces 47 linked by longitudinal conduits 46.

The bottom end of the tubing sub 38 is assembled by a coupling 39 with a valve cylinder case 60 having a smooth I.D. wall face 62. The interior surface of the wall face 62 provides an outer wall for an annular cylinder 56.

Concentrically within but radially spaced from the valve cylinder case 60 is the lower valve mandrel 50. The upper end of the lower valve mandrel serves as the inside wall for the annular cylinder 56. Below the cylinder 56 area is a circumferential depression 68, for example, in the outer surface of the lower valve mandrel. This depression 68 is a holding detent for a latch pawl 73 on the valve sleeve.

Below the holding detent 68, a plurality of fluid flow ports 54 through the valve mandrel wall are provided around the mandrel periphery. The downhole end of the lower mandrel flow bore is illustrated as closed by a pipe plug 58. Unless the mandrel is operatively attached to additional downhole tools, this flow bore is more frequently positioned within the well in the open pipe condition and plugged subsequently by a pump-down plug element. In such cases, the pipe plug 58 would be replaced by an open, ball seat, not shown.

In the space 47 and 56 between the cylinder case 60 and the lower mandrel 50 is an annular sear piston 64 having a thin sear skirt 65 that overlaps valve collet fingers 72. In the closed valve condition, the sear piston 64 is aligned within the cylinder 56 to position the skirt 65 for overlapping the collet fingers 72. This alignment denies the collet fingers 72 substantially all radial expansion space for withdrawing the finger pawls 73 from the detent 68. At this closed valve position, the piston 64 is secured by one or more shear screws 66 from unintended axial displacement from the closed valve position. Outside and inside O-ring seals 82 and 84, respectively, seal the wellbore annulus pressure above the packer 10 that prevails in the annular cylinder 56 from the mandrel bore pressure.

Well fluid flow through the flow ports 54 is directly controlled by the valve sleeve 70. O-ring seal 76 cooperates with the outside cylinder wall 62 and O-ring seal 76 cooperates with the outside surface of the lower mandrel 50 to isolate the production tube volume below the packer 10 from the pressure within the production tube bore above the flow ports 54. The coiled tension spring 80 wound around the lower valve mandrel 50 is secured to the lower edge of the valve sleeve 70 and to the retainer coupling 52. The standing bias of the spring 80 is to draw the valve sleeve 70 down to break the O-ring seal between the sleeve 70 and the inside wall 62 of the cylinder case 60.

Collet fingers 72 are integral extensions of the valve sleeve 70 and are tip bound by the integral band 74. Each finger 72 is isolated from adjacent fingers by longitudinal slots. The tension of spring 80 on the valve sleeve 70 is sufficient to dislodge the collet finger pawls 73 from the detent 68 and open the flow path through ports 54 except for the presence of the sear skirt 65. The skirt 65 prevents the expansion of the fingers 72 and release of the pawls 73 from the detent 68.

With respect to FIG. 2, initial pressure increase, 600 psi surface pressure, for example, within the upper tubing bore and valve mandrel bore 41 is transferred through the mandrel wall conduits 44 to expand the packer boot 34 against the well bore wall to isolate the well annulus above the packer from that below the packer 10.

Further pressure increases, to 8000 psi, for example, are not passed on to the packer boot due to operation of the boot conduit valve 35 to close the boot inflation conduit at about 650 psi, for example.

Although the packer 10 may be set at a much shallower well depth than the operational depth of the valve 12, due to the pressure continuity of the transfer channels 22, 46 and 47, the upper face of piston 64 is exposed only to the well pressure above the expanded annulus. The lower face of the piston 64 is exposed to the pressure within the mandrel flow bore 41 through the flow ports 54 and the slits between the collet fingers 72. This lower piston face pressure, therefore, is a surface controlled variable. Accordingly, when it is desired to open the valve 12 to well fluid flow from within the lower production tube sub 90, surface pump pressure is increased until the pressure differential,and hence, the force differential acting on opposite faces of annular piston 64 is sufficient to shear the set screws 66. When the set screws shear, the annular piston 66 moves to the upper end of the cylinder 56 and extracts the sear skirt 65. With the block removed, the collet fingers 72 are free to bow and be drawn by the tension spring 80 out of the detent 68. When released from the detent restraint, the O-ring 76 of valve sleeve 70 slides from sealing contact with the inside surface of the cylinder case 60 to open flow through the ports 54.

Having fully described the preferred embodiments of the present invention, various modifications will be apparent to those skilled in the art to suit the variations and circumstances suitable for certain well conditions and manufacturing capabilities. It is intended that all variations within the scope and spirit of the appended claims be embraced by the foregoing disclosure.

What is claimed is:

1. A well tool combination comprising a well annulus packer and a pressure differentially opened well production valve below said packer, said valve having a controlled flow port between a well bore externally of said valve and a pipe bore internally of said valve, said flow port being closed by a sliding sleeve that is resiliently biased to an open port position, said sleeve being held at a closed port position by a sear piston having first and second pressure faces, said packer comprising a fluid pressure transfer conduit from a well bore annulus above said packer to one face of said sear piston.

2. A well tool combination as described by claim 1 wherein fluid pressure within said well bore bears upon the first pressure face of said sleeve and fluid pressure within said pipe bore bears upon the second pressure face of said sleeve.

3. A well tool combination as described by claim 2 wherein said sear piston is secured at said closed port position by a shear fastener whereby said flow port is opened by a greater pressure on said second pressure face than on said first pressure face.

4. A well tool combination as described by claim 3 wherein said sliding sleeve comprises resiliently biased projections meshed into depressions at said closed port position.

5. A well tool combination as described by claim 4 wherein said sear piston comprises a skirt portion to overlie said biased projections when meshed into said depressions.

6. A well fluid production valve comprising:

(a) a valve mandrel having an axial flow bore therein and a fluid flow port transversely through said mandrel;

(b) a wellbore annulus sealing device disposed externally around said mandrel at a location that is axially displaced from said fluid flow port;

(c) a valve sleeve disposed externally around and axially slidable along said mandrel to selectively close and open said flow port, said sleeve being resiliently biased to open said flow port;

(d) collet fingers extending from said sleeve having pawls depending therefrom, said pawls being resiliently biased into mandrel recesses when said sleeve is axially aligned to close said flow port;

(e) an annular piston disposed externally around and axially slidable along said mandrel, said annular piston having a sear skirt to confine said collet fingers and pawls in said recesses;

(f) a first fluid conduit connecting a first face of said piston with fluid pressure in a wellbore annulus portion extending from said annulus sealing device in a direction opposite from said fluid flow port; and, (g) a second fluid conduit connecting a second face of said piston with fluid pressure within said flow bore whereby a selected pressure differential between said first and second piston faces displaces said piston to release said pawls and open said flow port.

7. A well fluid production valve as described by claim 6 wherein said annular piston axially translates within an annular cylinder between said mandrel and a cylinder case wall and said annular piston is fluid pressure sealed with said cylinder case wall and said mandrel.

8. A well fluid production valve as described by claim 7 wherein said valve sleeve is fluid pressure sealed with said cylinder case wall and said mandrel.

9. A well fluid production valve as described by claim 8 wherein said sear skirt laps said collet fingers between said cylinder case and said mandrel when said sleeve is axially aligned to cover said port.

10. A well fluid production valve as described by claim 9 wherein said second fluid conduit passes through said collet fingers when said sleeve is axially aligned to cover said port.

11. A well fluid production valve as described by claim 9 wherein said annular piston is secured at the covered port position by a shear fastener that must be sheared to open said flow port.

* * * * *